US010220438B2

(12) United States Patent
Okada et al.

(10) Patent No.: US 10,220,438 B2
(45) Date of Patent: Mar. 5, 2019

(54) IMMERSION NOZZLE

(71) Applicant: KROSAKIHARIMA CORPORATION, Fukuoka (JP)

(72) Inventors: Takuya Okada, Fukuoka (JP); Takahiro Kuroda, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 153 days.

(21) Appl. No.: 15/121,180

(22) PCT Filed: Feb. 5, 2015

(86) PCT No.: PCT/JP2015/053232
§ 371 (c)(1),
(2) Date: Aug. 24, 2016

(87) PCT Pub. No.: WO2015/129423
PCT Pub. Date: Sep. 3, 2015

(65) Prior Publication Data

US 2017/0014897 A1 Jan. 19, 2017

(30) Foreign Application Priority Data

Feb. 25, 2014 (JP) ..... 2014-34481

(51) Int. Cl.
*B22D 11/103* (2006.01)
*B22D 41/56* (2006.01)
(Continued)

(52) U.S. Cl.
CPC ..... *B22D 11/103* (2013.01); *B22D 11/10* (2013.01); *B22D 41/50* (2013.01); *B22D 41/502* (2013.01); *B22D 41/56* (2013.01)

(58) Field of Classification Search
CPC ..... B22D 11/10; B22D 11/103; B22D 41/50; B22D 41/502; B22D 41/56
(Continued)

(56) References Cited

U.S. PATENT DOCUMENTS 4,541,553 A 9/1985 McQuillen
5,170,915 A 12/1992 Szadkowski
(Continued)

FOREIGN PATENT DOCUMENTS

JP 61-037362 2/1986
JP 4-501535 3/1992
(Continued)

OTHER PUBLICATIONS

Machine Translation of portions of JP 2008-178899 (JP application published Aug. 7, 2008).
(Continued)

*Primary Examiner* — Scott R Kastler
*Assistant Examiner* — Michael Aboagye
(74) *Attorney, Agent, or Firm* — Paul D. Bianco; Stephen Bongini; Fleit Gibbons Gutman Bongini & Bianco PL

(57) ABSTRACT

An immersion nozzle for use with an immersion nozzle replacement apparatus, capable of preventing crack formation due to the presence of a neck region. The immersion nozzle includes a nozzle body, a flange, and a metal casing. The nozzle body is formed such that a region of an outer peripheral surface thereof located above a point of power of an upward supporting force from a supporting device extends vertically up to an upper edge of the nozzle body without any dimensional change with respect to an central axis of an inner bore of the nozzle body. The outer peripheral surface region is not joined to the metal casing.

19 Claims, 6 Drawing Sheets

(51) Int. Cl.
*B22D 41/50* (2006.01)
*B22D 11/10* (2006.01)

(58) Field of Classification Search
USPC ..... 222/590, 591, 594, 603, 606, 607; 266/236; 164/437; 501/133, 151, 154
See application file for complete search history.

(56) References Cited

U.S. PATENT DOCUMENTS

| | | | | |
|---|---|---|---|---|
| 5,992,711 | A | 11/1999 | Mochizuki et al. | |
| 6,902,121 | B2 * | 6/2005 | Kawano | B22D 41/50 239/390 |
| 8,056,776 | B2 * | 11/2011 | Lee | B22D 41/58 222/591 |
| 2008/0093780 | A1 | 4/2008 | Ebisawa | |
| 2009/0173757 | A1 * | 7/2009 | Lee | B22D 41/50 222/591 |
| 2010/0251533 | A1 | 10/2010 | Yamamoto | |

FOREIGN PATENT DOCUMENTS

| | | |
|---|---|---|
| JP | 4-50100 | 8/1992 |
| JP | 2793039 B2 | 9/1998 |
| JP | 11-5146 | 1/1999 |
| JP | 2000107838 | 4/2000 |
| JP | 2000343208 | 12/2000 |
| JP | 2001-030047 | 2/2001 |
| JP | 3394905 | 4/2003 |
| JP | 3523089 | 4/2004 |
| JP | 2008-178899 | 8/2008 |
| JP | 2008-178899 A | 8/2008 |
| JP | 2009-160609 | 7/2009 |
| WO | 2006/011269 | 2/2006 |

OTHER PUBLICATIONS

Machine Translation of portions of JP4-050100B.
Machine Translation of portions of JP11_005146A (JP application dated Jan. 12, 1998).
Machine Translation of portions of JP61_037362A (JP application dated Feb. 22, 1986).
English translation of Written Opinion dated Jul. 6, 2016 for PCT/JP2015/053232, filed Feb. 5, 2015 , 4 pages.
English translation of International Preliminary Report on Patentability dated Aug. 30, 2016 for PCT/JP2015/053232, filed Feb. 5, 2015.
International Search Report (with English translation) for PCT/JP2015/053232 dated Apr. 8, 2015.
Written Opinion for PCT/JP2015/053232 dated Apr. 21, 2015.

* cited by examiner

IMMERSION NOZZLE

TECHNICAL FIELD

The present invention relates to an immersion nozzle for use in pouring molten steel from a tundish apparatus into a casting mold in continuous casting of molten steel.

BACKGROUND ART

An immersion nozzle generally requires replacement for reasons such as breaking, fracture, and durability limit resulting from wear damage caused by molten steel or clogging of an inner bore thereof caused by adhesion and buildup of inclusions contained in molten steel, such as alumina particles which are non-metal particles, and such replacement inevitably causes interruption or stop of a steel continuous casting operation. As a means to realize prolonged pouring from a viewpoint of a need for improvement in efficiency of casting operation, an apparatus designed to replace an immersion nozzle with a new one while minimizing the interruption of a steel continuous casting operation has been introduced (see, for example, the following Patent Documents 1 and 2).

An immersion nozzle for use with such an immersion nozzle replacement apparatus has a fundamental structure which can be broadly divided into two elements: a tubular-shaped nozzle body having an inner bore extending in a vertical direction and serving as a molten steel flow pathway; and a flange formed by increasing a cross-sectional area with respect to the nozzle body in a horizontal direction, in such a manner that it can be supported by a supporting device of an immersion nozzle replacement apparatus, from therebelow to allow the nozzle body to be supported and pushed upwardly against the force of gravity and brought into contact with a member located thereabove. In this fundamental structure, an interface region between the nozzle body and the flange in which a cross-sectional area of the immersion nozzle increases will hereinafter be referred to as "neck region".

It is known that the neck region is a stress concentration point in structure, and crack can be formed due to a thermal stress and a mechanical stress applied thereto. The crack formed in the neck region poses a problem in terms of durable life of the immersion nozzle and quality of steel. When molten steel flows through the inner bore of the immersion nozzle, a pressure level in an internal space of the inner bore inclines toward a negative side, so that air is sucked through the crack formed in the neck region to cause oxidation of a carbon component constituting a refractory material. This is likely to lead to leakage of molten steel and to contamination of molten steel by oxygen.

Therefore, various proposals have heretofore been made for suppression of crack formation in the neck region as a technical problem (e.g., the following Patent Documents 3 to 6). These conventional techniques are intended to take measures from a viewpoint of a structure and shape of an immersion nozzle, and measures from a viewpoint of a material of an immersion nozzle, such as forming the nozzle body and the flange, respectively, by different materials. However, all of the measures fail to sufficiently prevent crack formation in the neck region. Because, as long as an immersion nozzle has a region in which a cross-sectional area of a nozzle body increases upwardly, i.e., has the neck region, the immersion nozzle can be deemed as a structure which is liable to be cracked when thermal and mechanical stresses are strongly applied thereto.

CITATION LIST

Parent Document

Patent Document 1: JP 2793039B
Patent Document 2: JP 04-050100B
Patent Document 3: JP 2000-343208A
Patent Document 4: JP 2001-030047A
Patent Document 5: JP 2008-178899A
Patent Document 6: JP 3523089B

SUMMARY OF INVENTION

Technical Problem

The present invention addresses a technical problem of preventing crack formation due to the presence of a neck region, in an immersion nozzle for use with an immersion nozzle replacement apparatus.

Solution to Technical Problem

In solving the above technical problem, the inventors focused on a simple fact that a stress causing crack formation in the neck region can be classified into a thermal stress and a mechanical stress. Specifically, concentration of a thermal stress is caused by the presence of a change in cross-sectional area, i.e., the presence of the neck region, and concentration of a mechanical stress is also caused by the presence of a change in cross-sectional area, i.e., the presence of the neck region. That is, the inventors found that forming a nozzle body in a shape free of a change in cross-sectional area, i.e., free of the neck region, is exactly suited to a measure against crack formation due to the presence of the neck region. For example, the shape includes a right circular tubular shape having no change in cross-sectional area.

Specifically, according to one aspect of the present invention, there is provided an immersion nozzle having the following feature.

"The immersion nozzle according to one aspect of the present invention comprises: a nozzle body composed of a refractory material and formed with an inner bore extending in a vertical direction; a flange composed of a flat plate-shaped refractory material, and joined to an outer periphery of an upper end of the nozzle body directly or through an adhesive, in a posture where it protrudes in a horizontal direction while surrounding the outer periphery of the upper end of the nozzle body; and a metal casing attached to surround an outer periphery of the flange and an outer periphery of a part of the nozzle body located just below the flange, wherein respective upper edge faces of the nozzle body and the flange lie in a same horizontal plane, and wherein the immersion nozzle is configured to be slidably moved in the horizontal direction while a lower surface of the flange is supported by a supporting device, and installed in such a manner that both of the upper edge faces of the nozzle body and the flange come into press contact with a lower edge face of an upper nozzle member located just above the immersion nozzle. The immersion nozzle is characterized in that: the nozzle body is formed such that a region of an outer peripheral surface thereof located above a point of power of an upward supporting force from the supporting device extends vertically up to an upper edge of the nozzle body without any dimensional change with respect to an central axis of the inner bore, wherein the outer peripheral surface region is not joined to the metal casing; and a joint strength between the nozzle body and the flange is less than a bending strength of each of the nozzle body and the flange."

As used in this specification, the term "bending strength" means a bending strength as measured by a measuring method according to JIS R2213. On the other hand, the term "joint strength" means a bending strength as measured by the above measuring method under a condition that a sample is cut out to allow an interface line of bonded surfaces of the nozzle body and the flange to become coincident with a longitudinally central line of the sample, and a pressing point is set at a position on the interface line.

Effect of Invention

According to the above feature, in the immersion nozzle of the present invention, the nozzle body is formed in a shape free of a change in cross-sectional area, i.e., free of the neck region. This makes it possible to prevent crack formation due to the presence of the neck region. As a result, it becomes to solve problems caused by air sucked through crack formed in the neck region, such as deterioration in durability of an immersion nozzle, and degradation in quality of steel due to incorporation of oxygen into molten steel, and thus achieve stability in steel continuous casting operation and prevention of degradation in quality of slabs.

The immersion nozzle of the present invention effectively functions, particularly when it is used with an immersion nozzle replacement apparatus having a strong force for pressing the immersion nozzle, and can effectively prevent crack formation due to the presence of the neck region, which has been unavoidable in a seamlessly integrally-structured (i.e., monoblock-type) immersion nozzle having a nozzle body and a flange each made of the same refractory material.

DESCRIPTION OF EMBODIMENTS

With reference to the drawings, an embodiment of the present invention will now be described.

Figure 1:
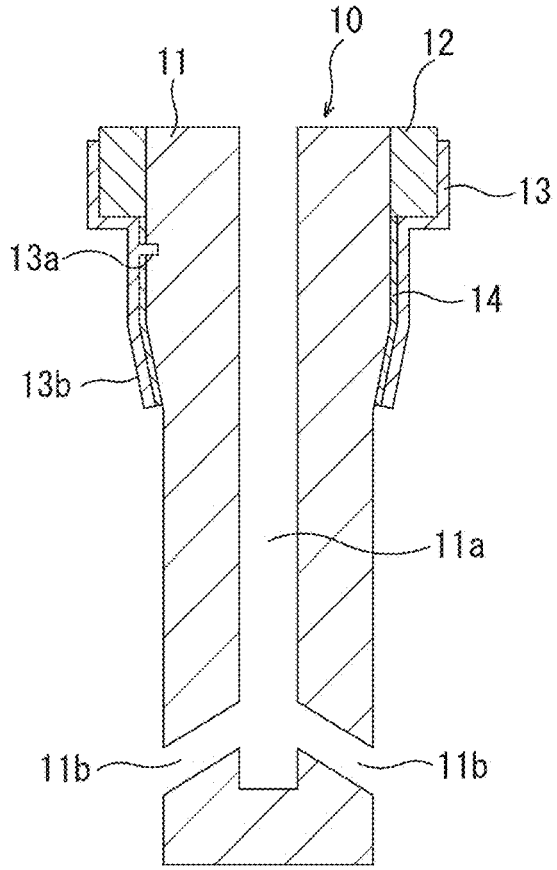
FIG. 1 is a sectional view depicting an immersion nozzle according to one embodiment of the present invention.
Figure 2:
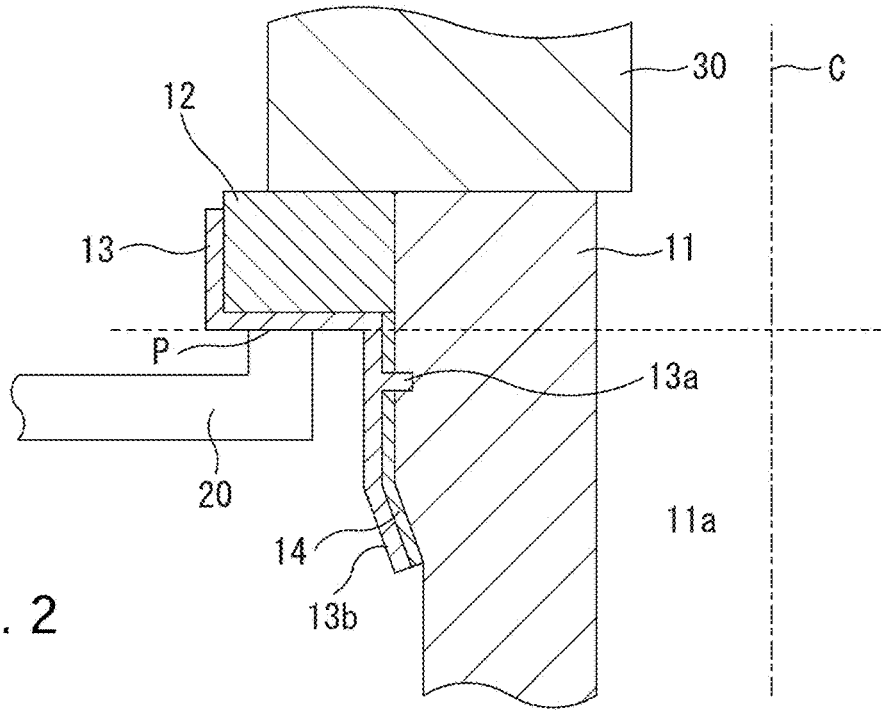
FIG. 2 is a sectional view depicting a substantial part of the immersion nozzle in FIG. 1 in a usage state.

FIG. 1 is a sectional view depicting an immersion nozzle according to one embodiment of the present invention, and FIG. 2 is a sectional view depicting a substantial part of the immersion nozzle in FIG. 1 in a usage state.

The immersion nozzle 10 according to this embodiment comprises a nozzle body 11 and a flange 12. The nozzle body 11 is composed of a refractory material (shaped refractory material), and formed with: an inner bore 11*a* extending in a vertical direction and serving as a molten steel flow pathway; and a pair of discharge ports 11*b* at a lower end thereof. The discharge ports 11*b* are arranged symmetrically to discharge molten steel into a casting mold therethrough. The flange 12 is composed of a flat plate-shaped refractory material (e.g., castable refractory material) different from the refractory material of the nozzle body, and joined to an outer periphery of an upper end of the nozzle body 11 directly or through an adhesive, in a posture where it protrudes in a horizontal direction while surrounding the outer periphery of the upper end of the nozzle body. Respective upper edge faces of the nozzle body 11 and the flange 12 lie in the same horizontal plane. Further, an outer periphery of the flange 12 and an outer periphery of a part of the nozzle body 11 located just below the flange 12 are surrounded by a metal casing 13. A joint sealing material 14 (e.g., an unshaped refractory material such as mortar, or a fiber sheet) is interposed between the metal casing 13 and the nozzle body 11.

The immersion nozzle 10 is configured to be slidably moved in the horizontal direction while a lower surface of the flange 12 is supported by a supporting device 20 of an immersion nozzle replacement apparatus, and installed in such a manner that both of the upper edge faces of the nozzle body 11 and the flange 12 come into press contact with a lower edge face of an upper nozzle member 30 located just above the immersion nozzle 10, as depicted in FIG. 2. The flange 12 may be formed in a planar shape selected from the group consisting of a rectangular shape, a polygonal shape, an elliptical shape and a round shape.

In addition to the above fundamental structure, the immersion nozzle 10 according to this embodiment is configured such that the nozzle body 11 is formed in a shape free of a change in cross-sectional area, i.e., free of the neck region, thereby solving the conventional problem of crack formation due to the presence of the neck region. That is, the nozzle body 11 is formed such that a region of an outer peripheral surface thereof located above a point P of power of an upward supporting force from the supporting device 20 (above the broken line in FIG. 2) extends vertically up to an upper edge of the nozzle body 11 without any dimensional change with respect to an central axis C of the inner bore 11*a*, wherein the outer peripheral surface region is not joined to the metal casing 13.

On the other hand, the conventional immersion nozzle cannot be supported against the force of gravity and pressed against the upper nozzle member 30 without the presence of the neck region. In contract, the immersion nozzle 10 according to this embodiment is configured such that the lower surface of the flange 12 formed separately from the nozzle body 30 is supported and pressed against the upper nozzle member 30 by the supporting device 20. That is, in the immersion nozzle 10 according to this embodiment, the upper edge face of the flange 12 is pressed against the lower surface of the upper nozzle member 30, so that almost no load is applied to the nozzle body 11. In other words, a compression stress generated by press contact of the upper edge face of the nozzle body 11 with the lower edge face of the upper nozzle member 30 is less than a compression stress generated by press contact of the upper edge face of the flange 12 with the lower edge face of the upper nozzle member 30.

In this embodiment, the nozzle body 11 and the flange 12 are formed separately and joined together directly or through an adhesive, so that a force by which the immersion nozzle 10 is pressed against the upper nozzle member 30 by the supporting device 20 supporting the lower surface of the flange 12 is concentrated on a joint interface between the nozzle body 11 and the flange 12. Thus, when a joint strength between the nozzle body 11 and the flange 12 is sufficiently low, the nozzle body 11 is kept from breaking because displacement occurs along the joint interface. On the other hand, when the joint strength is fairly large, a breakage phenomenon like neck fracture occurs. Therefore, in the immersion nozzle 10 according to this embodiment, the joint strength between the nozzle body 11 and the flange 12 is set to be less than a bending strength of each of the nozzle body 11 and the flange 12, thereby preventing the neck fracture.

In this embodiment, the lower surface of the flange 12 to be supported by the supporting device 20 is formed as a horizontal surface. This makes it possible to prevent a pressing force by the supporting device 20 from being concentrated excessively or locally at a certain position of the joint interface between the nozzle body 11 and the flange 12. It should be understood that, as long as the aforementioned requirements on the nozzle body 11 and the flange 12 are satisfied, the lower surface of the flange 12 does not necessarily have to be formed in a horizontal shape.

In the immersion nozzle 10 of the present invention, the nozzle body 11 is formed such that the region of the outer peripheral surface thereof located above the point P of power of the upward supporting force from the supporting device 20 extends vertically up to the upper edge of the nozzle body 11 without any dimensional change with respect to the central axis C of the inner bore 11*a,* wherein the outer peripheral surface region is not joined to the metal casing 13, as mentioned above. Thus, it is necessary to take measures to keep the nozzle body 11 from falling with the force of gravity.

In the immersion nozzle 10 depicted in FIG. 1, as one of the measures, the metal casing 13 is formed with a support portion for supporting the nozzle body 11. Specifically, the metal casing 13 has: a pin 13*a* formed on an inner periphery thereof and configured to be engaged with the nozzle body 11; and a lower portion formed as a taper portion 13*b* having an inner diameter which gradually decreases in a downward direction.

In the measure using the pin 13*a,* the nozzle body 11 needs to be formed with a recess for fitting engagement with the pin 13*a*. Thus, the recess is likely to become a structural defect because it serves as a stress concentration point. However, the immersion nozzle can be actually used without breaking starting from the recess, by virtue of a total effect of: stress relaxation by a filler constituting the pin 13*a* to be fittingly inserted (the pin 13*a* itself) and the joint sealing material 14 surrounding an outer periphery of the pin 13*a;* an effect of constraining the outer periphery of the nozzle body 11 by the metal casing 13; a low crack propagation property of a refractory material itself constituting the nozzle body 11; and the like.

For example, the applicant of this application is stably supplying to the market an immersion nozzle product having a structure for gas injection, wherein a gas pipe-coupling socket is implanted into a recess having a diameter 20 mm which is 13% of an outer diameter of the product of 150 mm, to a depth of 22 mm which is 67% of an effective wall thickness of the product of 32.5 mm. Thus, in view of this actual result, the recess for fitting engagement with the pin 13*a* is allowed to have a diameter which is 13% of an outer diameter of the nozzle body 11, and a depth which is 67% of an effective wall thickness of the nozzle body 11.

As above, the pin-recess structure can be designed with high flexibility, so that it may be substantially determined by factors such as a requirement that the depth is less than a remaining wall thickness calculated considering a wear speed of the nozzle, and easiness in installing the pin to the metal casing.

Figure 3:
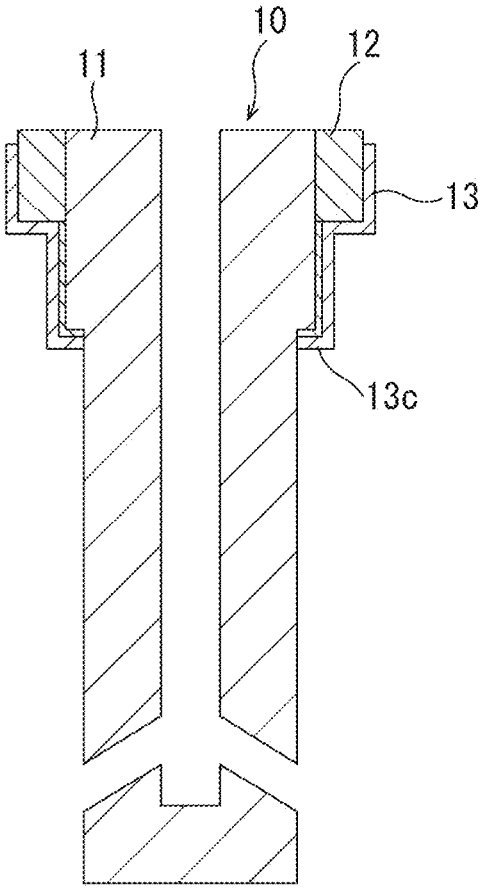
FIG. 3 is a sectional view depicting an immersion nozzle according to another embodiment of the present invention (one modification of a support portion).

In the immersion nozzle 10 according to this embodiment, the outer periphery of the flange 12 and the outer periphery of the part of the nozzle body 11 are surrounded by the metal casing 13, and the joint strength between the nozzle body 11 and the flange 12 is only necessary to be less than the bending strength of each of the nozzle body 11 and the flange 12, as mentioned above. Thus, in a situation where the joint strength is enough to support the nozzle body 11 without falling-down, the support portion, such as the pin 13*a* and/or the taper portion 13*b,* is not indispensable. Further, the support portion formed in the metal casing is not limited to the pin 13*a* and/or the taper portion 13*b*. For example, as depicted in FIG. 3, a support portion 13*c* may be formed by bending a lower end of the metal casing 13 inwardly at a right angle. This support portion 13*c* can also be deemed as an example in which a taper angle of the taper portion 13*b* is set to 90 degrees. Positions of these support portions (the pin 13*a,* the taper portion 13*b* and the support portion 13*c*) are not limited to those in FIGS. 1 and 3. In essence, they may be any position of the metal case located below the point P of power.

Figure 4:
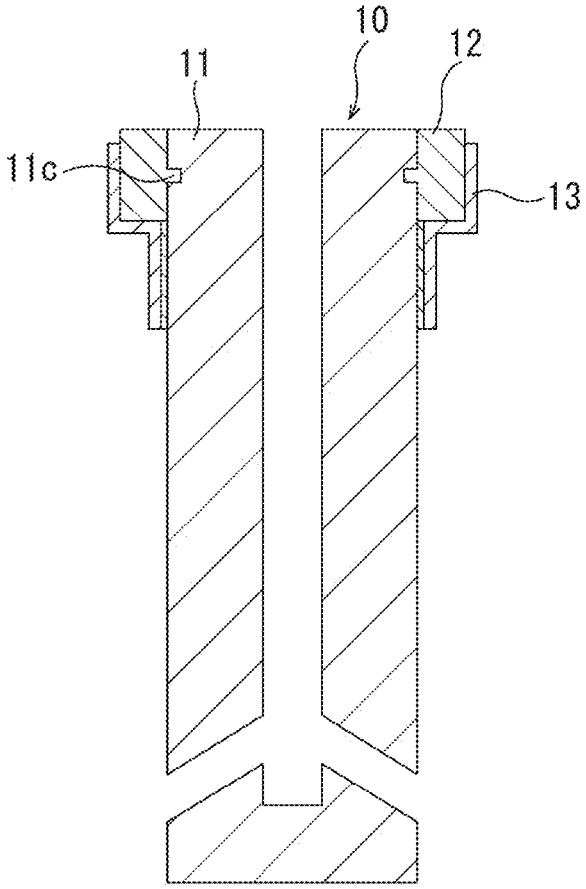
FIG. 4 is a sectional view schematically reproducing a nozzle structure disclosed in JP 05-507029A.

In a nozzle structure where a nozzle body 11 and a flange 12 are formed separately, as in the immersion nozzle 10 according to this embodiment, as a measure to prevent falling-down of the nozzle body 11, it is conceivable to employ a nozzle structure disclosed in JP 05-507029A, i.e., a nozzle structure in which a recess and a protrusion are formed, respectively, in the nozzle body 11 and the flange 12 at positions located above the point P of power in FIG. 2, so as to hold the nozzle body 11. FIG. 4 is a sectional view schematically reproducing the nozzle structure disclosed in JP 05-507029A, wherein a flange 12 composed of a castable refractory material is partially embedded in a plurality of dimples (recesses) 11*c* formed in an outer periphery of a nozzle body 11.

However, in this nozzle structure, a cross-sectional area of the nozzle body 11 decreases or increases in a region around the dimples 11*c*. This means that there is the neck region, i.e., a stress concentration point. The dimple region is effective in preventing falling-down of the nozzle body 11. However, particularly in the case where a force pressing the immersion nozzle 10 against an upper nozzle member is significantly large, the pressing force acts to push the flange 12 upwardly to generate an upward force acting on the region of the dimples 11*b,* possibly causing crack formation. The situation is the same in the case where the dimple (recess) 11*c* is replaced by a protrusion.

Figure 5:
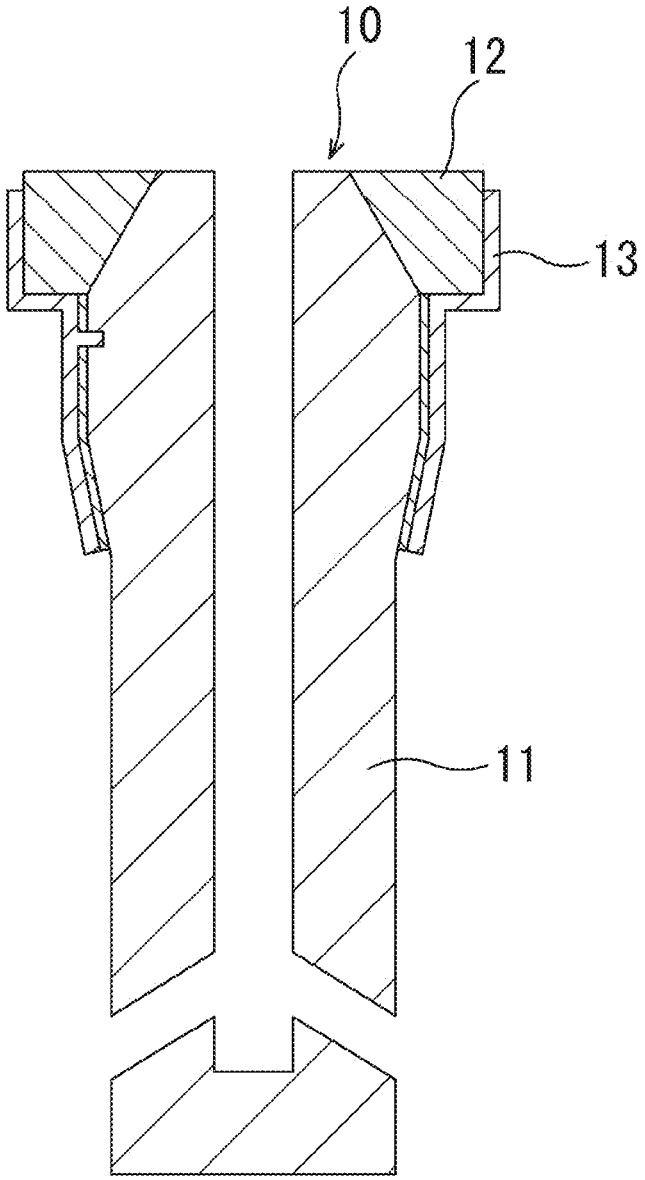
FIG. 5 is a sectional view depicting an immersion nozzle which is out of the scope of the present invention.

As a nozzle structure similar to the immersion nozzle 10 according to this embodiment, it is conceivable to reduce a cross-sectional area at an upper end of a nozzle body 11, as depicted in FIG. 5. However, this nozzle structure involves various problems, such as a high possibility that an acute-angled portion of a flange 12 is damaged during a sliding movement for immersion nozzle replacement, increase in cutting loss in a production process of the nozzle body 11, and deterioration in handling stability in the production process.

Considering the above, the nozzle structure of the immersion nozzle according to this embodiment, i.e., the structure in which the region of the outer peripheral surface of the nozzle body 11 located above the point P of power of the upward supporting force from the supporting device 20 extends vertically up to the upper edge of the nozzle body 11 without any dimensional change with respect to the central axis C of the inner bore 11*a*, wherein the outer peripheral surface region is not joined to the metal casing 13, is optimal as a solution to the technical problem of the present invention.

The immersion nozzle 10 according to this embodiment can be produced, for example, in the following manner.

The nozzle body 11 is preliminarily prepared and set to the metal casing 13, and then a castable refractory material is filled between the metal casing 13 and the nozzle body 11 to form the flange 12. In this process, the nozzle body 11 and the flange 12 are formed such that respective upper edge faces thereof each serving as a press contact surface with the lower surface of the upper nozzle member 30 protrude upwardly from the metal casing 13. Thus, the nozzle body 11 and the flange 12 are subsequently subjected to machining to allow the upper edge faces thereof to form a common horizontal surface. The metal casing 13 is preliminarily subjected to drilling to form therein a hole for allowing the pin 13*a* to be installed therein. Then, the nozzle body 11 is subjected to drilling to form a hole at a position corresponding to the hole of the metal casing 13, and the pin 13*a* is fitted in the aligned holes and welded to the metal casing 13.

Although the present invention has been described with reference to a specific embodiment, it should be understood that the present invention is not limited thereto. For example, although the above embodiment has been described based on an example where the flange 12 is formed of a castable refractory material, the flange may be formed of a shaped refractory material.

In the above embodiment, for the sake of a clear explanation, the nozzle body 11 has been depicted simply as an isomorphic integral structure. However, the present invention is not necessarily limited to such an isomorphic integral structure. For example, a portion of the nozzle body 11, such as a part of an outer peripheral portion of the nozzle body 11 corresponding to a powder layer in a mold, a part or an entirety of a surface of the inner bore, or a part or an entirety of a surrounding area of the discharge ports, may be formed using a refractory material different from that for a remaining portion of the nozzle body 11. Further, for example, it is possible to employ a structure in which the nozzle body 11 is provided with a gas pool and a gas introduction passage for injecting gas into the inner bore.

A result obtained by verifying the advantageous effects of the present invention through FEM (Finite Element Method) analysis will be described below.

Figure 6:
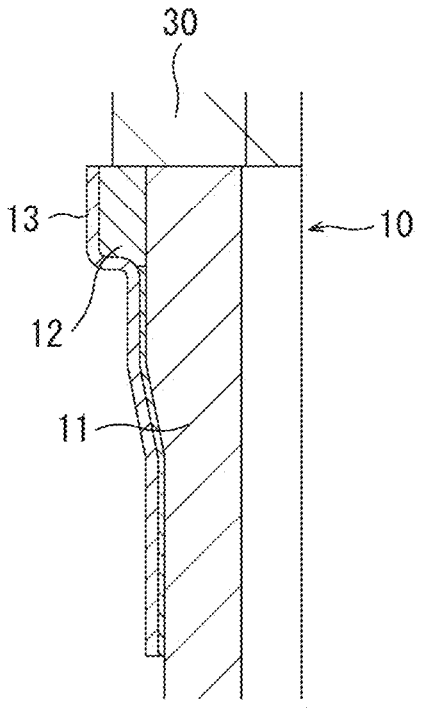
FIG. 6 is a diagram depicting a part of an analytical model (inventive example) used in FEM analysis.
Figure 7:
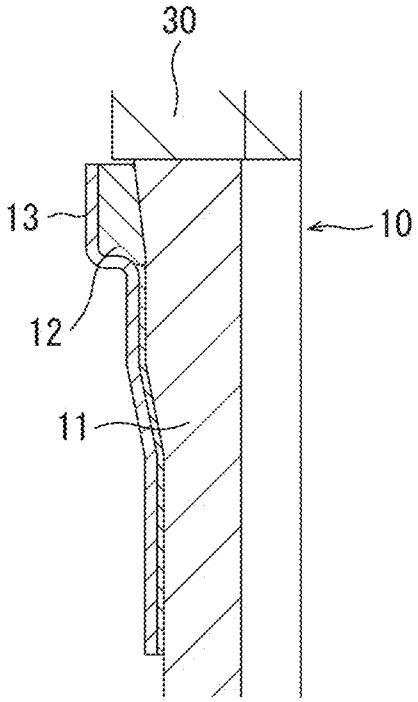
FIG. 7 is a diagram depicting a part of an analytical model (comparative example) used in FEM analysis.

FIGS. 6 and 7 depict two analytical models used in the FEM analysis.

FIG. 6 depicts an inventive example in which a nozzle body 11 is formed such that a region of an outer peripheral surface thereof located above a point of power of an upward supporting force from a supporting device of an immersion nozzle replacement apparatus extends vertically up to an upper edge of the nozzle body 11 without any dimensional change with respect to an central axis of an inner bore of the nozzle body 11, wherein the outer peripheral surface region is not joined to a metal casing 13, and respective upper edge faces of the nozzle body 11 and a flange 12 are in press contact with a lower surface of an upper nozzle member 30.

FIG. 7 depicts a comparative example in which a nozzle body 11 is formed such that a portion thereof located above the point of power of the upward supporting force from the supporting device is gradually increased in outer diameter to keep the nozzle body 11 from falling with the force of gravity. Further, an upper edge face of the nozzle body 11 protrudes from an upper edge face of the flange 12 by 1 mm, and, in a press contact state with the upper nozzle member 30, only the upper edge face of the nozzle body 11 is in press contact with the lower surface of the upper nozzle member 30, without contact between the flange 12 and the upper nozzle member 30.

In both of the two analytical models, the nozzle body 11 and the flange 12 were formed, respectively, of a shaped refractory material and a castable refractory material, and directly joined together. In this case, a joint strength between the nozzle body 11 and the flange 12 is extremely low. Thus, in the FEM analysis, an interface between the nozzle body 11 and the flange 12 was defined as being in a contact state (contact surfaces), i.e., set such that a displacement can occur between the contact surfaces by an external force. Then, to each of the analytical models, a supporting force from the supporting device of the immersion nozzle replacement apparatus, heat from molten steel passing through the inner bore, and natural cooling for an outer periphery thereof, are applied to simultaneously generate a mechanical stress and a thermal stress therein.

Figure 8:
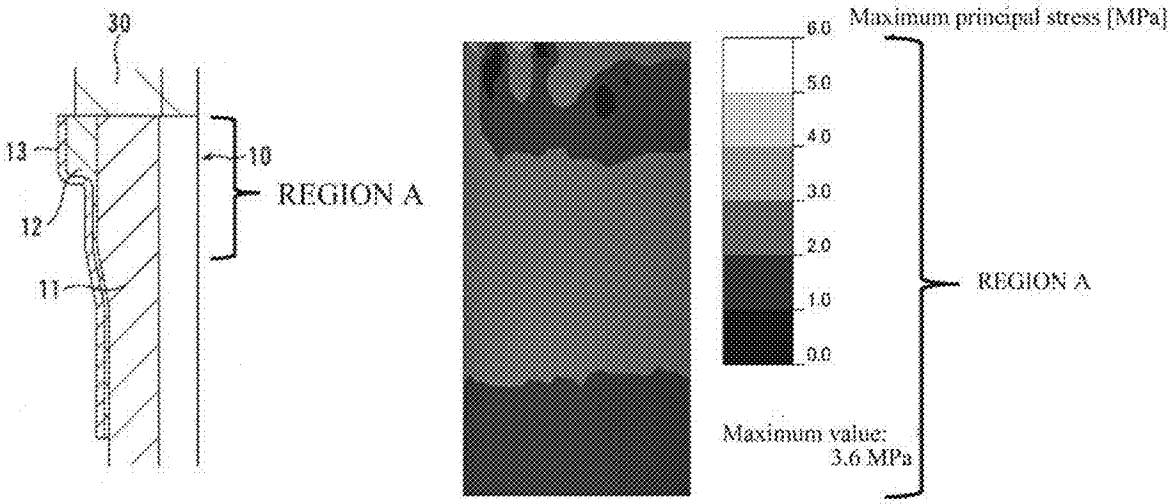
FIG. 8 is an explanatory diagram depicting a distribution of stress generated in a nozzle body in the inventive example in FIG. 6.
Figure 9:
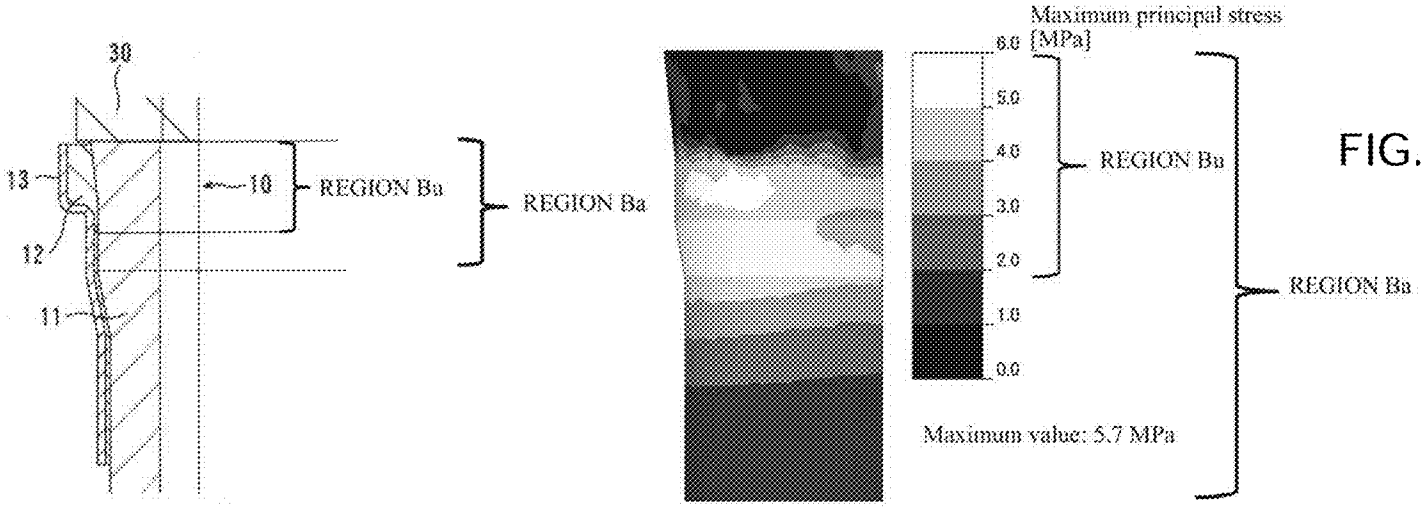
FIG. 9 is an explanatory diagram depicting a distribution of stress generated in a nozzle body in the comparative example in FIG. 7.

Results of the FEM analyses are presented in FIGS. 8 and 9. FIG. 8 depicts a distribution of stress generated in the nozzle body 11 in the inventive example in FIG. 6, and FIG. 9 depicts a distribution of stress generated in the nozzle body 11 in the comparative example in FIG. 7.

As is evident from FIG. 8, in the inventive example depicted in FIG. 6, no large concentration of generated stress was observed, and a maximum principal stress was 3.6 MPa. On the other hand, as is evident from FIG. 9, in the comparative example depicted in FIG. 9, a significant concentration of generated stress was observed in the neck region (the outer diametrally-enlarged portion of the nozzle body 11), and a maximum principal stress was 5.7 MPa.

Whether or not the maximum principal stress in the FEM analysis is led to breaking of the nozzle body 11 may be determined by comparing it with a tension strength of a refractory material forming the nozzle body 11. A bending strength of a commonly-used refractory material for the nozzle body is about 8 to 10 MPa, and a tension strength thereof can be assumed to be about 4 to 5 MPa. The maximum principal stress obtained in the FEM analysis has a definition in the field of the strength of materials, specifically, tension strength. Considering the above, in the inventive example depicted in FIG. 6, the maximum principal stress is 3.6 MPa which does not exceed a breaking strength of the commonly-used refractory material for the nozzle body. Thus, the nozzle body 11 never undergoes breaking. On the other hand, in the comparative example depicted in FIG. 7, the maximum principal stress is 5.7 MPa which exceeds the breaking strength of the commonly-used refractory material for the nozzle body. This leads to breaking of the nozzle body 11.

An immersion nozzle having the shape of the inventive example in FIG. 6 was used in an actual continuous casting apparatus. As a result, no crack formation was observed. In the same way, an immersion nozzle having the shape of the comparative example in FIG. 7 was used. As a result, a crack was formed in a region where the highest stress value was observed in the FEM analysis, i.e., in the neck region.

LIST OF REFERENCE SIGNS

10: immersion nozzle
11: nozzle body
11*a*: inner bore
11*b*: discharge port
11*c*: dimple (recess)
12: flange
13: metal casing
13*a*: pin (support portion)
13*b*: taper portion (support portion)
13*c*: support portion
14: joint sealing material
20: supporting device
30: upper nozzle member

The invention claimed is:

1. An immersion nozzle for use with a supporting device comprising:

a nozzle body composed of a refractory material and formed with an inner bore extending in a vertical direction;

a flange composed of a flat plate-shaped refractory material, and joined to an outer periphery of an upper end of the nozzle body directly or through an adhesive, in a posture where it protrudes in a horizontal direction while surrounding the outer periphery of the upper end of the nozzle body; and a metal casing attached to surround an outer periphery of the flange and an outer periphery of a part of the nozzle body located just below the flange, wherein respective upper edge faces of the nozzle body and the flange lie in a same horizontal plane, wherein the immersion nozzle is configured to be slidably moved in the horizontal direction while a lower surface of the flange is supported by the supporting device, and installed in such a manner that both of the upper edge faces of the nozzle body and the flange come into press contact with a lower edge face of an upper nozzle member located just above the immersion nozzle, wherein the nozzle body is formed such that a region of an outer peripheral surface thereof located above a point of power of an upward supporting force from the supporting device extends vertically up to an upper edge of the nozzle body without any dimensional change with respect to a central axis of the inner bore, wherein the outer peripheral surface region is not joined to the metal casing; and wherein a joint strength between the nozzle body and the flange is less than a bending strength of each of the nozzle body and the flange.

2. The immersion nozzle of claim 1, wherein the metal casing has a support portion formed below the horizontal line including the point of power to support the nozzle body.

3. The immersion nozzle of claim 1, wherein the flange is composed of a castable refractory material.

4. The immersion nozzle of claim 1, wherein the flange has a planar shape selected from the group consisting of a rectangular shape, a polygonal shape, an elliptical shape and a round shape.

5. The immersion nozzle of claim 2, wherein the flange has a planar shape selected from the group consisting of a rectangular shape, a polygonal shape, an elliptical shape and a round shape.

6. The immersion nozzle of claim 3, wherein the flange has a planar shape selected from the group consisting of a rectangular shape, a polygonal shape, an elliptical shape and a round shape.

7. The immersion nozzle of claim 2, wherein the flange is composed of a castable refractory material.

8. The immersion nozzle of claim 7, wherein the flange has a planar shape selected from the group consisting of a rectangular shape, a polygonal shape, an elliptical shape and a round shape.

9. The immersion nozzle of claim 1, wherein the metal casing includes a pin formed on an inner periphery of the metal casing, the pin being engaged with a recess in the nozzle body located below a horizontal line including the point of power so as to support the nozzle body.

10. The immersion nozzle of claim 1, wherein a lower portion of the metal casing is formed as a taper portion with an inner diameter that decreases in a downward direction so as to support the nozzle body, all of the taper portion being located below a horizontal line including the point of power.

11. The immersion nozzle of claim 10, wherein a taper angle of the taper portion is 90 degrees.

12. The immersion nozzle of claim 1, wherein neither the metal casing nor the flange has a support portion for supporting the nozzle body formed above a horizontal line including the point of power.

13. The immersion nozzle of claim 1, wherein the nozzle body is formed in a shape free of a change in cross-sectional area above a horizontal line including the point of power.

14. The immersion nozzle of claim 1, wherein the nozzle body and the flange are composed of different refractory materials.

15. The immersion nozzle of claim 1, wherein the nozzle body and the flange are separately formed and joined together so as not to be a single integral structure.

16. The immersion nozzle of claim 1, wherein the nozzle body is an isomorphic integral structure.

17. The immersion nozzle of claim 1, wherein all of the lower surface of the flange is formed as a horizontal surface.

18. The immersion nozzle of claim 1, wherein all of the outer periphery of the flange is formed as a vertical surface.

19. The immersion nozzle of claim 1, wherein the upper edge faces of the nozzle body and the flange protrude upwardly from the metal casing.

* * * * *